US010826189B2

(12) United States Patent
Luo et al.

(10) Patent No.: US 10,826,189 B2
(45) Date of Patent: Nov. 3, 2020

(54) FREQUENCY SELECTIVE SURFACE

(71) Applicant: HUAWEI TECHNOLOGIES CO., LTD., Shenzhen (CN)

(72) Inventors: Xin Luo, Chengdu (CN); Yi Chen, Chengdu (CN); Kun Li, Chengdu (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 99 days.

(21) Appl. No.: 16/232,053

(22) Filed: Dec. 26, 2018

(65) Prior Publication Data

US 2019/0131713 A1 May 2, 2019

Related U.S. Application Data

(63) Continuation of application No. PCT/CN2016/101596, filed on Oct. 9, 2016.

(51) Int. Cl.
*H01Q 15/14* (2006.01)
*H01Q 19/10* (2006.01)
(Continued)

(52) U.S. Cl.
CPC ..... *H01Q 15/148* (2013.01); *H01Q 5/50* (2015.01); *H01Q 15/0013* (2013.01);
(Continued)

(58) Field of Classification Search
CPC ..... H01Q 15/148; H01Q 5/50; H01Q 19/10; H01Q 15/0013; H01Q 17/00; H01Q 15/16
See application file for complete search history.

(56) References Cited

U.S. PATENT DOCUMENTS 5,373,302 A 12/1994 Wu
5,543,815 A * 8/1996 Wu ..... H01Q 1/526 343/893
(Continued)

FOREIGN PATENT DOCUMENTS

CN 103700951 A 4/2014
CN 106876975 A 6/2017
(Continued)

OTHER PUBLICATIONS

Yi-Min Yu et al.,"An Effective Via-Based Frequency Adjustment and Minimization Methodology for Single-Layered Frequency-Selective Surfaces",IEEE Transactions on Antennas and Propagation, vol. 63, No. 4, Apr. 2015,total 9 pages.
(Continued)

*Primary Examiner* — Graham P Smith
*Assistant Examiner* — Jae K Kim
(74) *Attorney, Agent, or Firm* — Kilpatrick Townsend & Stockton LLP

(57) ABSTRACT

Embodiments provide a frequency selective surface (FSS). The FSS includes uniformly arranged FSS units. Each FSS unit includes a dielectric slab, a cross-shaped metal patch, and N square-ring metal patches. The cross-shaped metal patch is adhered to a first surface of the dielectric slab, and divides the first surface of the dielectric slab into four parts. Each part has a same size and a same quantity of the square-ring metal patches. The N square-ring metal patches are adhered to the first surface of the dielectric slab, and are arranged uniformly, and N is a positive integer power of 4. Lengths of the cross-shaped metal patch in two mutually perpendicular directions are equal, and both a length in each direction and a width of a gap between adjacent patches need to meet a specific condition.

12 Claims, 5 Drawing Sheets

(51) Int. Cl.

| | |
|---|---|
| ***H01Q 5/50*** | (2015.01) |
| ***H01Q 15/16*** | (2006.01) |
| ***H01Q 15/00*** | (2006.01) |
| ***H01Q 17/00*** | (2006.01) |

(52) U.S. Cl.
CPC ..... *H01Q 15/16* (2013.01); *H01Q 17/00* (2013.01); *H01Q 19/10* (2013.01)

(56) References Cited

U.S. PATENT DOCUMENTS

| | | | | |
|---|---|---|---|---|
| 9,559,426 | B1 * | 1/2017 | Cross | H01Q 1/42 |
| 10,068,703 | B1 * | 9/2018 | Contopanagos | H01Q 15/0086 |
| 10,325,915 | B2 * | 6/2019 | Salvia | H01L 27/0925 |
| 2004/0263420 | A1 * | 12/2004 | Werner | H01Q 17/00 343/909 |
| 2011/0210903 | A1 | 9/2011 | Sarabandi et al. | |
| 2012/0032865 | A1 * | 2/2012 | Toyao | H01Q 15/14 343/835 |
| 2012/0326800 | A1 * | 12/2012 | Liu | H01Q 17/00 333/32 |
| 2013/0050006 | A1 * | 2/2013 | Sim | H01Q 17/00 342/4 |
| 2013/0194161 | A1 * | 8/2013 | Alexopoulos | H01Q 19/10 343/913 |
| 2013/0200947 | A1 * | 8/2013 | Alexopoulos | H01Q 5/0006 327/560 |
| 2013/0201072 | A1 * | 8/2013 | Alexopoulos | H01Q 5/0066 343/834 |
| 2014/0022139 | A1 * | 1/2014 | Rao | H01O 15/006 343/841 |
| 2014/0028524 | A1 * | 1/2014 | Jerauld | H01Q 17/00 343/893 |
| 2014/0097995 | A1 * | 4/2014 | McKinzie, III | H01Q 9/045 343/793 |
| 2014/0211298 | A1 * | 7/2014 | Sayyah | H01L 29/66151 359/298 |
| 2015/0155635 | A1 * | 6/2015 | Liu | H01Q 5/0053 343/840 |
| 2015/0270622 | A1 * | 9/2015 | Takasaki | H01Q 5/385 343/797 |
| 2016/0011307 | A1 * | 1/2016 | Casse | G01S 13/931 701/93 |
| 2016/0020648 | A1 * | 1/2016 | Contopanagos | H01Q 15/006 307/104 |
| 2016/0231417 | A1 * | 8/2016 | Aoki | G01S 7/032 |

FOREIGN PATENT DOCUMENTS

| | | | | |
|---|---|---|---|---|
| EP | 1826870 | A1 * | 8/2007 | H01Q 15/0053 |
| EP | 3252871 | A1 * | 12/2017 | H01Q 3/22 |
| JP | S4816554 | B1 | 3/1973 | |
| JP | S56137704 | A | 10/1981 | |
| JP | H01147515 | U | 10/1989 | |
| JP | 2001313524 | A | 11/2001 | |
| JP | 2005210016 | A | 8/2005 | |
| JP | 3839606 | B2 | 11/2006 | |
| KR | 101408306 | B1 | 6/2014 | |
| KR | 20160013697 | A | 2/2016 | |
| WO | WO-2015186805 | A1 * | 12/2015 | H01Q 15/0046 |
| WO | WO-2016121375 | A1 * | 8/2016 | H01Q 19/185 |

OTHER PUBLICATIONS

Min-Jie Huang et al "A New Type of Combined Element Multiband Frequency Selective Surface", IEEE Transactions on Antennas and Propagation, vol. 57, No. 6, Jun. 1, 2009, pp. 1798-1803, XP011261749.

Huanqing Wang et al:"The Design of Multi-bandpass FSS", 2015 IEEE 12th Intl Conf on Ubiquitous Intelligence and Computing and 2015 IEEE 12th Intl Conf on Autonomic and Trusted Computing and 2015 IEEE 15th Intl Conf on Scalable Computing and Communications and Its Associated Workshops(UIC-ATC-SCALCOM), Aug. 1, 2015, pp. 1591-1596,XP055568320.

J.P.Gianuittorio et al:"Self-similar prefractal frequency selective surfaces for multiband and dual-polarized applications", IEEE Transactions on Antennas and Propagation, vol. 51, No. 11, Nov. 1, 2003, pp. 3088-3096, XP055568574.

Payne Komlan et al:"Highly-selective miniaturized first-order low-profile dual-band frequency selective surface", 2016 IEEE International Symposium on Antennas and Propagation (APSURSI), IEEE, Jun. 26, 2016, pp. 955-956, XP032984368.

Fallahi A et al: "Analysis of multilayer frequency selective surfaces on periodic and anisotropic substrates", Metamaterials, Elsevier BU, NL, vol. 3, No. 2, Oct. 1, 2009, pp. 63-74, XP026690970.

* cited by examiner

FREQUENCY SELECTIVE SURFACE

CROSS-REFERENCE TO RELATED APPLICATIONS

This application is a continuation of International Application No. PCT/CN2016/101596, filed on Oct. 9, 2016, the disclosure of which is hereby incorporated by reference in its entirety.

TECHNICAL FIELD

The present application relates to the field of wireless communications technologies, and in some embodiments, to a single-layer double-resonance frequency selective surface (FSS).

BACKGROUND

With rapid development of wireless communications technologies, a transmission capacity in microwave point-to-point communication continuously increases, and an E-band (71 to 76 GHz, 81 to 86 GHz) frequency band microwave device plays an increasingly important role in a base station backhaul network. However, because "rain fade" on an Eband frequency band electromagnetic wave is extremely severe, an Eband microwave single-hop distance is usually less than 3 kilometers. To increase the Eband microwave single-hop distance and reduce site deployment costs, a solution is provided, in which the Eband frequency band microwave device and another low frequency microwave device are cooperatively used. When there is relatively heavy rain, even if the Eband microwave device cannot normally work, the low frequency microwave device can still normally work.

A dual-band parabolic antenna is used in this solution, and a structure is shown in FIG. 1. The dual-band parabolic antenna includes a primary reflector and a secondary reflector. A low frequency feed and a high frequency feed share the primary reflector. A frequency selective surface (FSS) is used as the secondary reflector. The secondary reflector is designed as a hyperboloid, a virtual focus of the hyperboloid and a real focus of the primary reflector are overlapped, and the feeds of different frequencies are respectively disposed at the virtual focus and a real focus of the hyperboloid. The FSS transmits an electromagnetic wave transmitted by the low frequency feed located at the virtual focus, and reflects an electromagnetic wave transmitted by the high frequency feed located at the real focus, so as to implement a dual-band multiplexing function.

The FSS has a two-dimensional periodic-arrangement structure, and can effectively control transmission and reflection of an incident electromagnetic wave. There are generally two types of FSSs. One type of FSS fully transmits an incident wave in a resonance case, and the other type of FSS fully reflects an incident wave in a resonance case. The dual-band parabolic antenna requires the FSS to have both a relatively good low frequency transmission feature and a relatively good high frequency reflection feature, that is, to have a double-resonance feature. Therefore, the two types of FSSs need to be cooperatively used.

A dual-band flat-plate including a two-layer FSS is used in an existing solution. The dual-band flat-plate includes dual-band flat-plate units that are periodically arranged in sequence along two mutually perpendicular directions. Each dual-band flat-plate unit includes a first FSS unit, a second FSS unit, and a dielectric slab, and a structure of the dual-band flat-plate unit is shown in FIG. 2. The first FSS unit includes four ring patches, covers a surface on a side of the dielectric slab, and mainly provides a function of high frequency reflection. The second FSS unit includes square patches with a circular groove excavated and wheel-shaped patches, covers a surface on the other side of the dielectric slab, and mainly provides a function of low frequency transmission. However, a relative bandwidth for low frequency band transmission of the dual-band flat-plate is only 9%. In addition, the dual-band flat-plate uses a double-layer FSS structure, and this increases a processing difficulty and costs.

SUMMARY

Embodiments of the present invention provide a single-layer double resonance FSS, so as to resolve problems that there is only 9% relative bandwidth during low frequency transmission on an existing dual-band flat-plate, a double-layer structure processing difficulty is large, and costs are high.

According to a first aspect, a frequency selective surface (FSS) is provided, where the FSS includes multiple FSS units that are uniformly arranged, each FSS unit includes a dielectric slab and N square-ring metal patches, the N square-ring metal patches are adhered to a first surface of the dielectric slab, and the FSS unit further includes a cross-shaped metal patch, where the cross-shaped metal patch is adhered to the first surface of the dielectric slab, and divides the first surface of the dielectric slab into four parts with an equal area, each part has a same quantity of the square-ring metal patches, the N square-ring metal patches are neatly arranged, and N is a positive integer power of 4; and lengths of the cross-shaped metal patch in two mutually perpendicular directions are equal, a length in each direction is 0.25 to 0.75 times a first wavelength, a width of a gap between adjacent patches is 0.02 to 0.06 times a second wavelength, the first wavelength is a wavelength that is corresponding to a transmission band center frequency of the FSS and that is in the dielectric slab, and the second wavelength is a wavelength that is corresponding to a reflection band center frequency of the FSS and that is in vacuum.

Low frequency transmission bandwidth is larger in the embodiments of the present invention. In addition, a single-layer structure is used, and the structure is simple. Therefore, a conventional printed circuit board technology can be used for implementation, and a processing difficulty and costs are reduced.

With reference to the first aspect, in a first possible implementation of the first aspect, a perimeter of a center line of the square-ring metal patch is 0.5 to 1.5 times the second wavelength, and the center line is located in the middle between an outer ring and an inner ring of the square-ring metal patch.

With reference to the first aspect, in a second possible implementation of the first aspect, a thickness of the dielectric slab is half of the first wavelength. In the embodiments of the present invention, reflection of the transmitted electromagnetic wave from a front facet of the dielectric slab is mutually offset with that from a back facet of the dielectric slab, and therefore, the low frequency band transmission bandwidth is increased.

With reference to the first aspect, or the first or the second possible implementation of the first aspect, in a third possible implementation of the first aspect, the dielectric slab in the FSS unit has N holes, positions of the N holes are in a one-to-one correspondence with positions of the N square-ring metal patches, and an area of the hole is less than an area of the inner ring of the square-ring metal patch. In the embodiments of the present invention, an equivalent Q value of a low frequency band-pass equivalent circuit can be reduced, so as to further increase the low frequency band transmission bandwidth.

With reference to the third possible implementation of the first aspect, in a fourth possible implementation of the first aspect, centers of the N holes are respectively located at center positions of the dielectric slab covered by the N square-ring metal patches. Therefore, an effect of increasing the low frequency band transmission bandwidth is better.

With reference to the first aspect, or the first or the second possible implementation of the first aspect, in a fifth possible implementation of the first aspect, when N is equal to 4, the length of the cross-shaped metal patch in each direction is 0.3 to 0.6 times the first wavelength; and the perimeter of the center line of the square-ring metal patch is 1.0 to 1.5 times the second wavelength, and the center line is located in the middle between the outer ring and the inner ring of the square-ring metal patch. A size of the patch is further limited in the embodiments, so as to better adapt to a specific case in which the FSS unit includes four square-ring metal patches. In this way, the FSS unit in the embodiments can obtain larger low frequency transmission bandwidth.

With reference to the first aspect, or the first or the second possible implementation of the first aspect, in a sixth possible implementation of the first aspect, when N is equal to 16, the length of the cross-shaped metal patch in each direction is 0.4 to 0.7 times the first wavelength; and the perimeter of the center line of the square-ring metal patch is 0.7 to 1.3 times the second wavelength, and the center line is located in the middle between the outer ring and the inner ring of the square-ring metal patch. A size of the patch is further limited in the embodiments, so as to better adapt to a specific case in which the FSS unit includes 16 square-ring metal patches. In this way, the FSS unit in the embodiments can obtain larger low frequency transmission bandwidth.

Larger low frequency transmission bandwidth can be provided in the embodiments of the present invention. In addition, a single-layer structure is used, and the structure is simple. Therefore, a conventional printed circuit board technology can be used for implementation, and there are advantages including a low processing difficulty and low processing costs.

BRIEF DESCRIPTION OF DRAWINGS

To describe the technical solutions in the embodiments of the present invention or in the prior art more clearly, the following briefly describes the accompanying drawings required for describing the embodiments or the prior art. Apparently, the accompanying drawings in the following description show merely some embodiments of the present invention, and a person of ordinary skill in the art may still derive other drawings from these accompanying drawings without creative efforts.

FIG. 3(*b*) is a schematic diagram of a planar structure of an FSS unit according to the present invention;

FIG. 7(*b*) is a simulation diagram of high frequency band transmission coefficients according to an embodiment of the present invention.

DESCRIPTION OF EMBODIMENTS

The following describes the technical solutions in the embodiments of the present invention with reference to the accompanying drawings in the embodiments of the present invention. Apparently, the described embodiments are a part rather than all of the embodiments of the present invention.

In the following description, to illustrate rather than limit, specific details such as a particular system structure, an interface, and a technology are provided to make a thorough understanding of the present invention. However, a person skilled in the art should know that the present invention may be practiced in other embodiments without these specific details. In other cases, detailed descriptions of well-known apparatuses, circuits, and methods are omitted, so that the present invention is described without being obscured by unnecessary details.

It should be understood that ordinal numbers such as "first" and "second", if mentioned in the embodiments of the present invention, are only used for distinguishing, unless the ordinal numbers definitely represent a sequence according to the context.

To facilitate understanding of a person skilled in the art, the following embodiments are used in the present invention to describe the technical solutions provided in the present invention.

Figure 1:
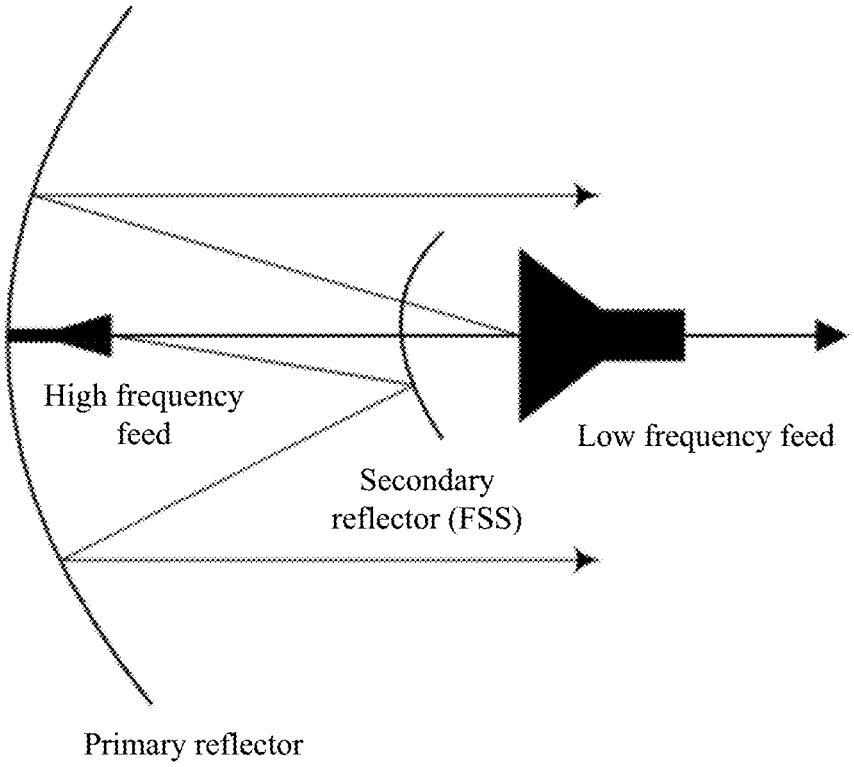
FIG. 1 is a schematic structural diagram of a dual-band parabolic antenna.
Figure 2:
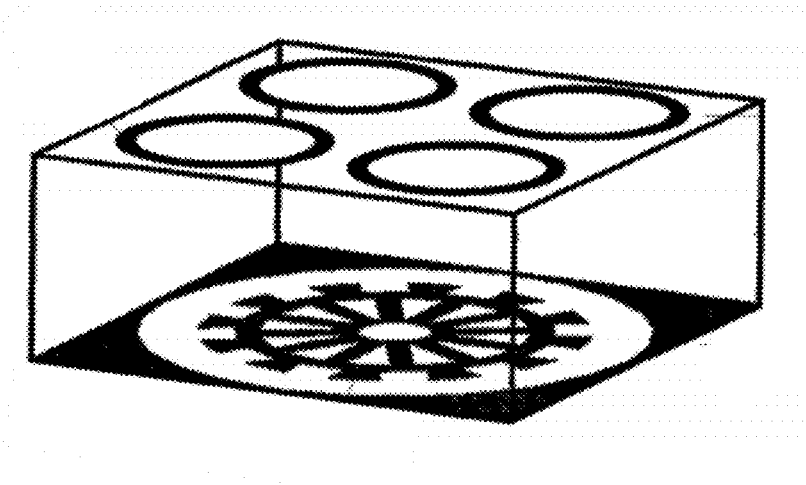
FIG. 2 is a diagram of a three-dimensional structure of an existing dual-band flat-plate unit.

FIG. 1 shows a structural diagram of a dual-band parabolic antenna. It can be seen from the figure that, the dual-band parabolic antenna includes a primary reflector and a secondary reflector, and a low frequency feed and a high frequency feed share the primary reflector. An FSS provided in the embodiments of the present invention may be used as the secondary reflector. The secondary reflector is designed as a hyperboloid, a virtual focus of the hyperboloid and a real focus of the primary reflector are overlapped, and the feeds of different frequencies are respectively disposed at the virtual focus and a real focus of the hyperboloid. The FSS transmits an electromagnetic wave transmitted by the low frequency feed located at the virtual focus, and reflects an electromagnetic wave transmitted by the high frequency feed located at the real focus, so as to implement a dual-band multiplexing function.

Figure 3A:
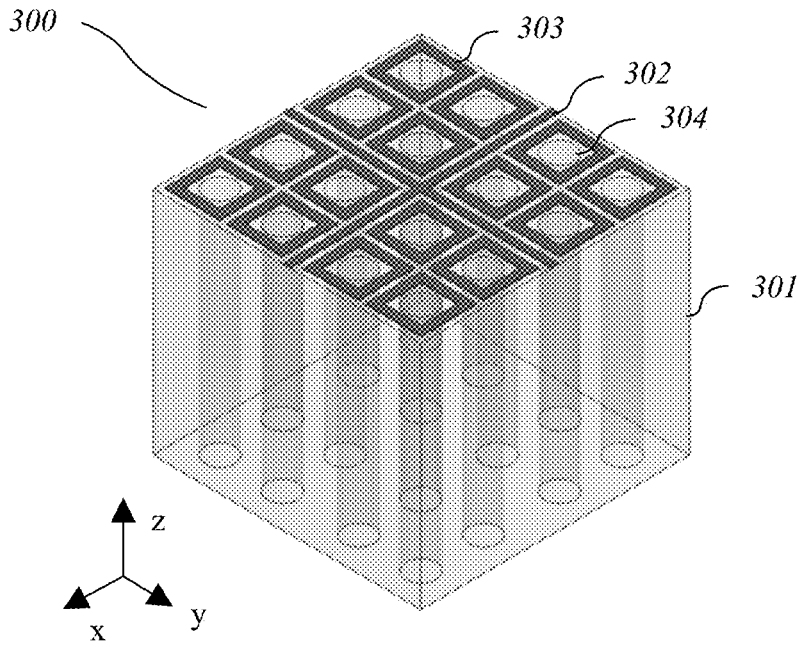
FIG. 3(*a*) is a schematic diagram of a three-dimensional structure of an FSS unit according to the present invention.
Figure 3B:
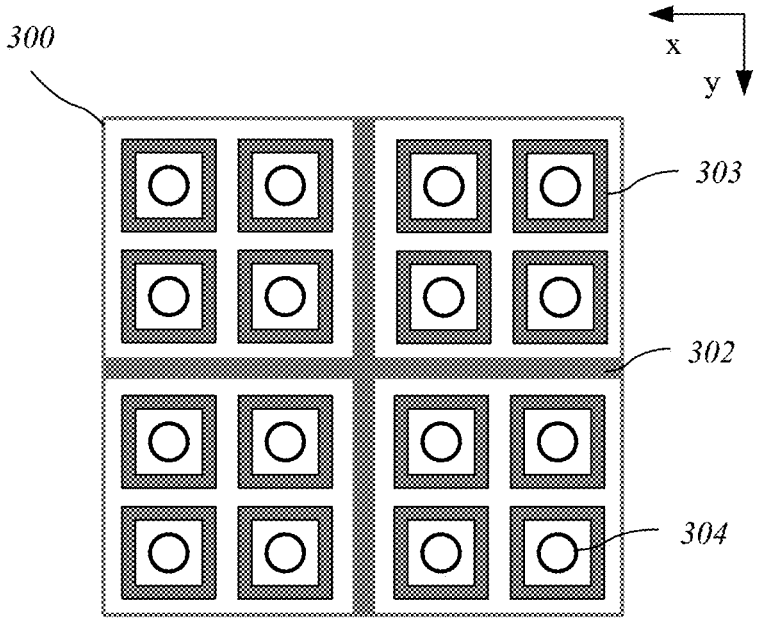

An embodiment of the present invention provides an FSS, and the FSS includes multiple FSS units that are uniformly arranged. Each FSS unit includes a dielectric slab and N square-ring metal patches, and the N square-ring metal patches are adhered to a first surface of the dielectric slab. FIG. 3(*a*) and FIG. 3(*b*) respectively show a diagram of a possible three-dimensional structure and a diagram of a possible planar structure of the FSS unit. An FSS unit 300 further includes a cross-shaped metal patch 302.

The cross-shaped metal patch 302 is adhered to a first surface of a dielectric slab 301, and divides the first surface of the dielectric slab 301 into four parts, each part has a same size and a same quantity of square-ring metal patches 303, the N square-ring metal patches 303 are uniformly arranged, and N is a positive integer power of 4. Lengths of the cross-shaped metal patch 302 in two mutually perpendicular directions are equal, a length in each direction is 0.25 to 0.75 times of a first wavelength, a width of a gap between adjacent patches is 0.02 to 0.06 times of a second wavelength, the first wavelength is a wavelength is in the dielectric slab 301 and corresponding to a transmission band center frequency of the FSS, and the second wavelength is a wavelength in vacuum and corresponding to a reflection band center frequency of the FSS.

In some embodiments, a relationship between a frequency (f) and a wavelength (λ) is $v=f\times\lambda$, and v represents a speed of light in a dielectric. In vacuum, v is equal to the speed of light, that is, $3\times10^8$ m/s. In a dielectric, v is related to a refractive index of the dielectric. If a refractive index of the dielectric slab 301 is n, v=Speed of light/n.

Figure 4:
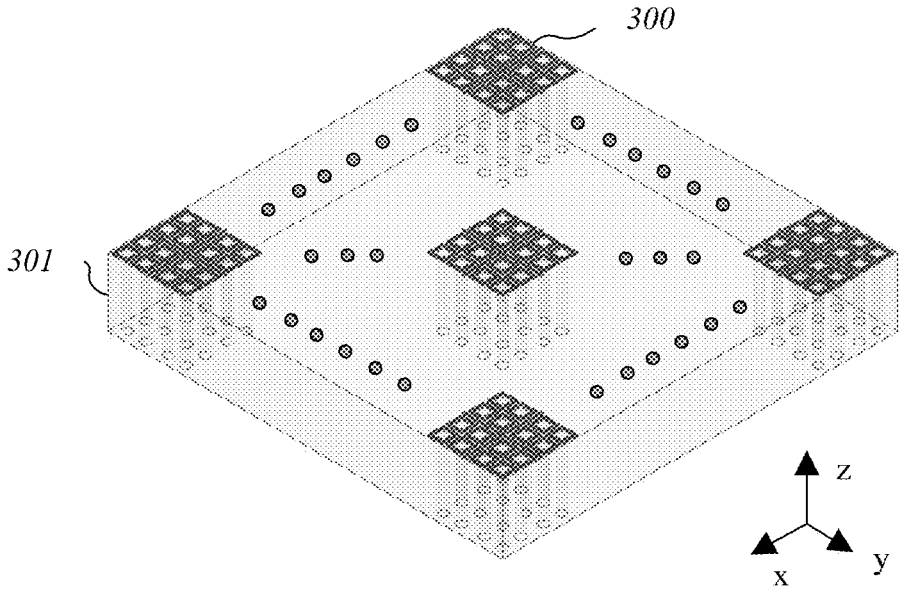
FIG. 4 is a schematic diagram of a three-dimensional structure of an FSS according to the present invention.

A whole structure of the FSS is shown in FIG. 4. It can be seen from FIG. 4 that, the FSS includes the FSS units 300 that are first periodically arranged along an x-axis and then periodically arranged long a y-axis, or first periodically arranged along the y-axis and then periodically arranged along the x-axis.

It should be understood that, an FSS unit 300 including 16 square-ring metal patches 303 is used as an example in FIG. 3(*a*) and FIG. 3(*b*), and a specific quantity of square-ring metal patches 303 is not limited. Actually, a quantity of the square-ring metal patches 303 included in each FSS unit 300 may be 4, 16, 64, or the like, and needs to be set according to a specific case.

Figure 5:
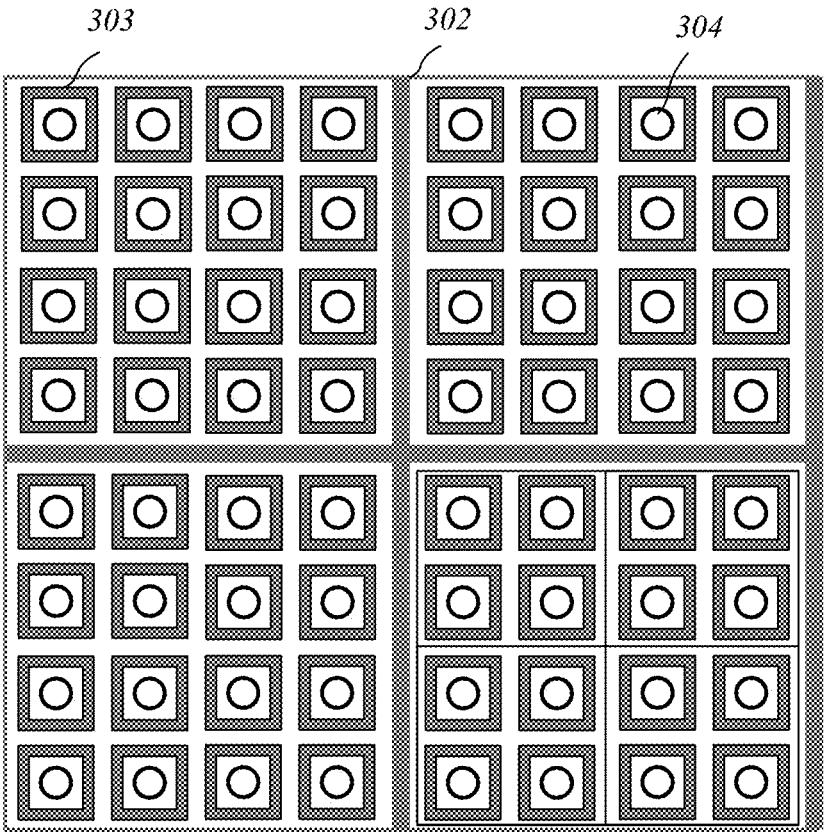
FIG. 5 is a schematic diagram of a planar structure formed after FIG. 3(*b*) is expanded.

FIG. 5 is a partial schematic diagram obtained after the FSS units shown in FIG. 3(*b*) are periodically arranged along the x-axis and the y-axis in sequence. In FIG. 5, a part in which 16 square-ring metal patches 303 in the middle and a cross-shaped metal patch are located is the FSS unit 300 shown in FIG. 3(*b*).

In some embodiments, the square-ring metal patches 303 are metallic and periodically arranged. Therefore, the square-ring metal patches 303 may be equivalent to inductors, and gaps between the square-ring metal patches 303 may be equivalent to capacitors. After periodic arrangement, the FSS structure may be equivalent to capacitors and inductors that are connected in series. Because a size of a square-ring metal patch 303 is small, an equivalent circuit of the square-ring metal patch 303 generates series resonance for a high frequency band (for example, a frequency band of about 80 GHz). The entire FSS structure is equivalent to a wall, and therefore, presents a good reflection feature. Gaps between the cross-shaped metal patch 302 and the square-ring metal patches 303 can form "2×2 grid" gaps (as illustrated by solid lines in a 2×2 grid in the lower right corner in FIG. 5). The "2×2 grid" gaps may be equivalent to capacitors, and metal between the "2×2 grid" gaps may be equivalent to an inductor. After periodic arrangement, the FSS structure may be equivalent to capacitors and inductors that are connected in parallel. Because a size of the "2×2 grid" gap is large, an equivalent circuit of the gap generates parallel resonance for a low frequency band (for example, a frequency band of about 20 GHz). The entire FSS structure is considered as nonexistent, and therefore, presents a good transmission feature.

Further, in this embodiment of the present invention, the quantity of the square-ring metal patches 303 included in each FSS unit 300 is a positive integer power of 4. This can ensure that the square-ring metal patches 303 are uniformly adhered in the four regions that are obtained by the cross-shaped metal patch by means of division and that are on the first surface of the dielectric slab 301, and can ensure that widths of all gaps are within a design scope, so that resonance can occur at both a low frequency band and a high frequency band. In this way, the FSS provided in this embodiment of the present invention has a high frequency reflection feature and a low frequency transmission feature.

In some embodiments, a thickness of the dielectric slab 301 is half of the first wavelength, and the first wavelength is the wavelength that is corresponding to the transmission band center frequency of the FSS and that is in the dielectric slab 301. When the dielectric slab 301 with the thickness that is half of the first wavelength is used, front facet reflection and back facet reflection have a same amplitude and opposite phases, and therefore, transmitted electromagnetic wave reflection from a front facet is mutually offset with that from a back facet, so as to increase transmission bandwidth of the FSS.

Further, N holes 304 may be designed on the dielectric slab 301. As shown in FIG. 3(*a*) and FIG. 3(*b*), the N holes 304 are in a one-to-one correspondence with the N square-ring metal patches 303, so that a Q value of a band-pass equivalent circuit (series resonance) at a low frequency band can be reduced. Consequently, the transmission bandwidth of the FSS is further increased. Centers of the N holes 304 are respectively located at center positions of the dielectric slab 301 covered by the N square-ring metal patches 303. Observation along a direction perpendicular to the first surface of the dielectric slab 301 shows that the centers of the holes 304 and centers of the square-ring metal patches 303 are overlapped.

It should be understood that, for easiest implementation, the hole 304 is circular. However, another shape may also increase the transmission bandwidth of the FSS. Therefore, a shape of the hole 304 is not limited in this embodiment of the present invention.

In some embodiments, to achieve better high frequency reflection performance and low frequency transmission performance at a high frequency band (about 80 GHz) and a low frequency band (about 18 GHz) at which the dual-band antenna usually operates, sizes of the square-ring metal patch 303 and the cross-shaped metal patch 302 and a position relationship between them are further defined in two typical cases in which the FSS unit 300 separately includes 4 and 16 square-ring metal patches 303:

(1) When the FSS unit 300 includes 4 square-ring metal patches 303, the lengths of the cross-shaped metal patch 302 in the two mutually perpendicular directions are equal, and the length in each direction is 0.3 to 0.6 times the first wavelength. A perimeter of a center line of the square-ring metal patch 303 is 1.0 to 1.5 times the second wavelength, and the width of the gap between adjacent patches is 0.02 to 0.06 times the second wavelength.

(2) When the FSS unit 300 includes 16 square-ring metal patches 303, the lengths of the cross-shaped metal patch 302 in the two mutually perpendicular directions are equal, and the length in each direction is 0.4 to 0.7 times of the first wavelength. A perimeter of a center line of the square-ring metal patch 303 is 0.7 to 1.3 times of the second wavelength, and the width of the gap between adjacent patches is 0.02 to 0.06 times of the second wavelength.

Figure 6:
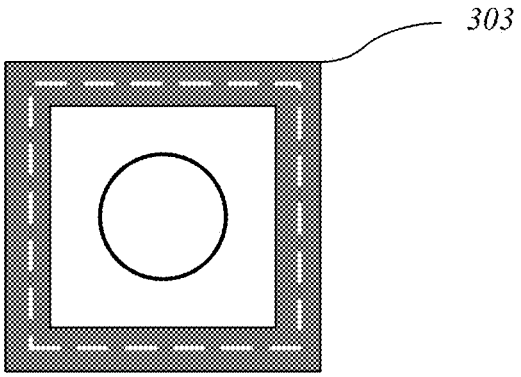
FIG. 6 is a diagram of a planar structure of a single square-ring metal patch.

It should be noted that, the first wavelength is the wavelength in the dielectric slab 301 and corresponding to the transmission band center frequency of the FSS, and the second wavelength is the wavelength in vacuum and corresponding to the reflection band center frequency of the FSS. A center line of the square-ring metal patch 303 is illustrated by a dash line in FIG. 6, and is located in the middle between an outer ring and an inner ring of the square-ring metal patch 303.

In addition, a specific reflection band center frequency and a specific transmission band center frequency may be better adapted to by adjusting four parameters: the perimeter of the center line of the square-ring metal patch 303, a center distance between adjacent square-ring metal patches 303 (that is, a sum of a side length of the square-ring metal patch 303 and a width of a gap between the adjacent patches), a total length of the cross-shaped metal patch 302 (a sum of the lengths in the two mutually perpendicular directions), and a width of a gap between adjacent patches. For example, the FSS unit 300 includes 16 square-ring metal patches 303, and operates at a reflection band center frequency of 80 GHz and a transmission band center frequency of 18 GHz. In this case, an effect is better in the following setting manner: The perimeter of the center line of the square-ring metal patch 303 is set to $0.96\lambda_1$, the center distance between adjacent square-ring metal patches 303 to $0.33\lambda_1$, the total length of the cross-shaped metal patch 302 to $1.09\lambda_2$, and the width of the gap between adjacent patches to $0.015\lambda_2$. $\lambda_1$ is a vacuum wavelength corresponding to 80 GHz, and is specifically 3.75 mm. $\lambda_2$ is a dielectric wavelength corresponding to 18 GHz. If a relative dielectric constant of the dielectric slab 301 is 2.8, a specific value of $\lambda_2$ is 9.69 mm.

In the same condition, if the reflection band center frequency is unchanged, but the transmission band center frequency changes to 15 GHz, an effect is better in the following setting manner: The perimeter of the center line of the square-ring metal patch 303 is set to $1.28\lambda_1$, the center distance between adjacent square-ring metal patches 303 to $0.41\lambda_1$, the total length of the cross-shaped metal patch 302 to $1.09\lambda_2$, and the width of the gap between adjacent patches to $0.013\lambda_2$. In this case, $\lambda_1$ is still 3.75 mm. If the relative dielectric constant of the dielectric slab 301 is still 2.8, the specific value of $\lambda_2$ changes to 11.95 mm.

Figure 7A:
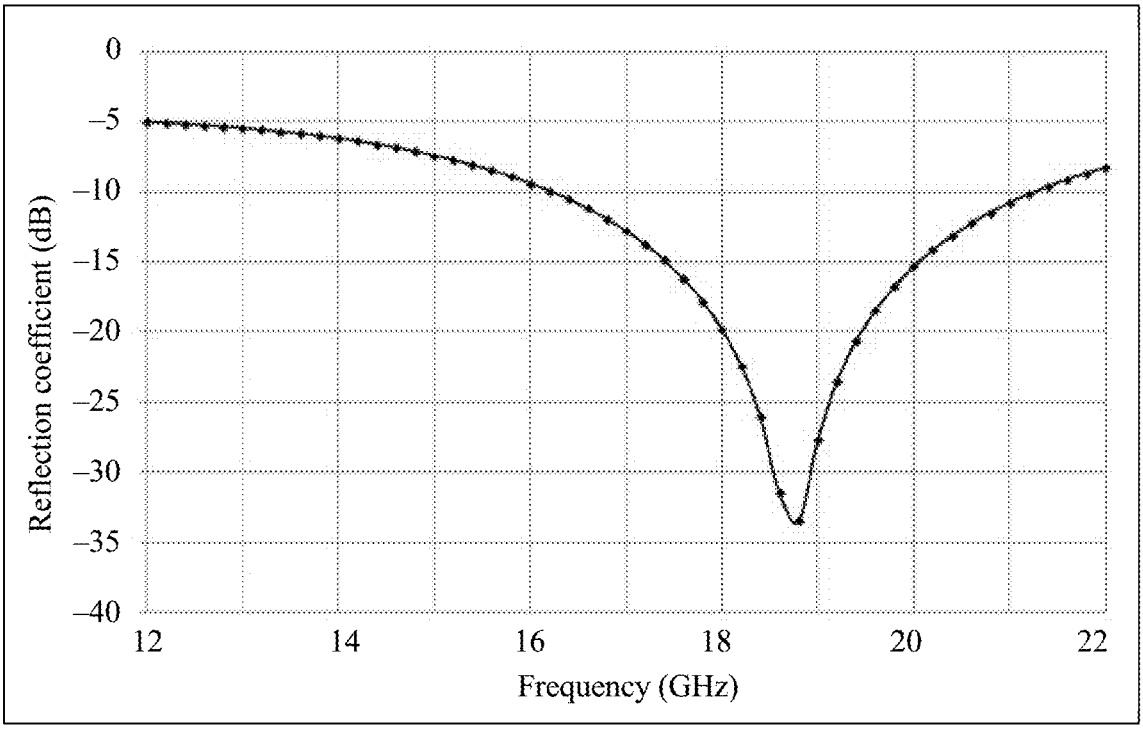
FIG. 7(*a*) is a simulation diagram of low frequency band reflection coefficients according to an embodiment of the present invention.
Figure 7B:
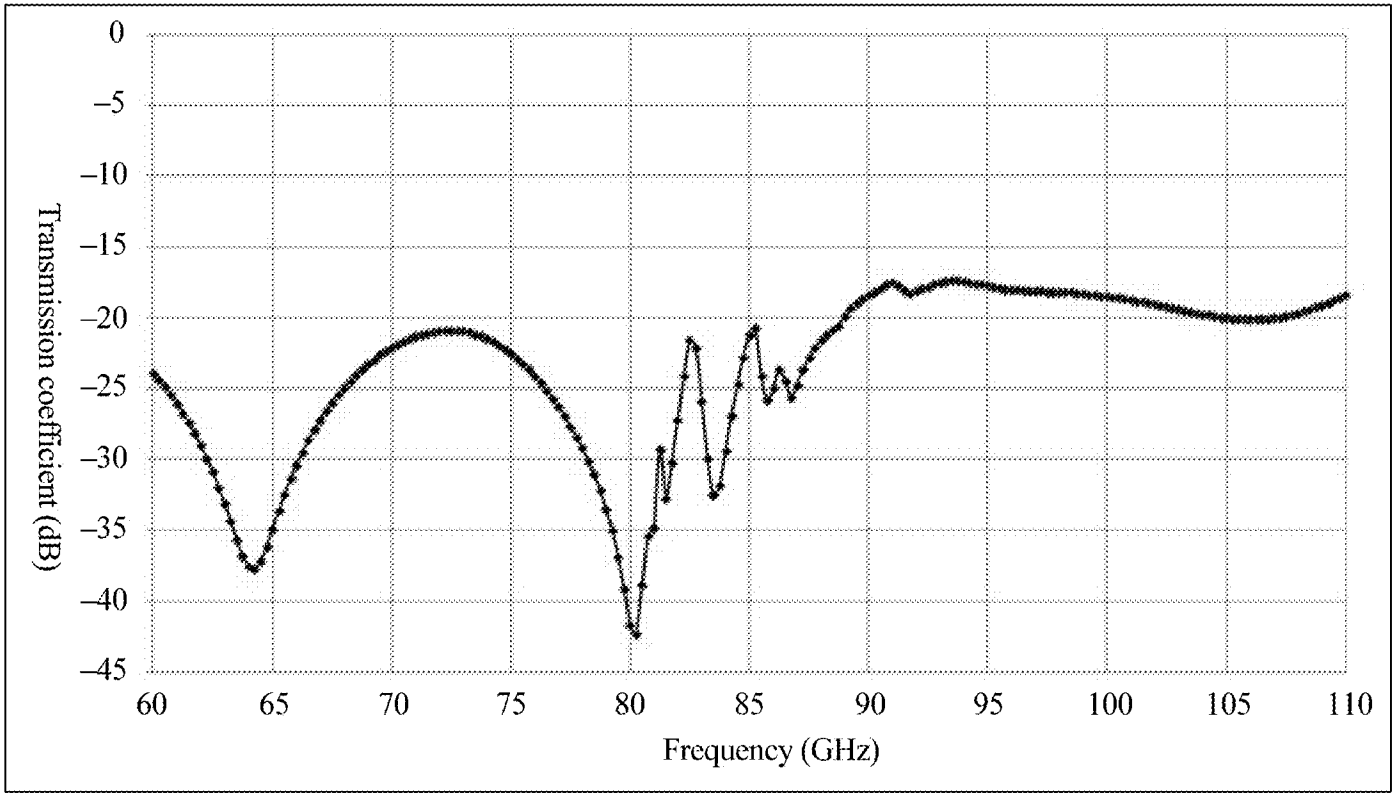

Further, in an example in which the FSS unit 300 includes 16 square-ring metal patches 303, the thickness of the dielectric slab 301 is half of the first wavelength, the N holes 304 are designed on the dielectric slab 301, the positions of the N holes 304 are respectively corresponding to the N square-ring metal patches 303, and the centers of the N holes 304 are respectively located at the center positions of the dielectric slab 301 covered by the N square-ring metal patches 303. In this case, low frequency transmission performance and high frequency reflection performance of the FSS are respectively shown in FIG. 7(*a*) and FIG. 7(*b*). FIG. 7(*a*) and FIG. 7(*b*) show simulation results in this embodiment of the present invention. In can be seen from FIG. 7(*a*) that, when a reflection coefficient is less than −10 dB, an operating band is from 16.22 GHz to 21.26 GHz, an absolute bandwidth is 21.26−16.22=5.04 GHz, and a center frequency is 18.74 GHz. Therefore, a relative bandwidth can reach 26.9% (5.04/18.74), and is far greater than a relative bandwidth for low frequency band transmission in the prior art. In can be seen from FIG. 7(*b*) that, when a transmission coefficient is less than −15 dB, an operating band is from 60 GHz to 110 GHz, an absolute bandwidth is 110−60=50 GHz, and a center frequency is 85 GHz. Therefore, a relative bandwidth can reach 58.8% (50/85), and is also greater than a relative bandwidth for high frequency band reflection in the prior art.

In conclusion, larger low frequency transmission bandwidth and high frequency reflection bandwidth can be provided in this embodiment of the present invention, and performance is better than that in an existing dual-band flat-plate solution. In addition, an FSS is designed on a single surface of a dielectric slab 301, and a structure is simple. Therefore, a conventional printed circuit board technology can be used for implementation, and there are advantages including a low processing difficulty and low processing costs.

The foregoing descriptions are merely some examples of the present invention, but are not intended to limit the protection scope of the present invention. Any variation or replacement readily figured out by a person skilled in the art within the technical scope disclosed in the present invention shall fall within the protection scope of the present invention. Therefore, the protection scope of the present invention shall be subject to the protection scope of the claims.

What is claimed is:

1. A frequency selective surface (FSS), wherein the FSS comprises multiple FSS units that are uniformly arranged, each FSS unit comprising a dielectric slab and N square-ring metal patches and a cross-shaped metal patch, wherein the cross-shaped metal patch is adhered to the first surface of the dielectric slab, and divides the first surface of the dielectric slab into four parts, each part having a same size and a same quantity of the square-ring metal patches, wherein lengths of the cross-shaped metal patch in two mutually perpendicular directions are equal, a length in each direction is 0.25 to 0.75 times of a first wavelength, and a width of a gap between adjacent patches is 0.02 to 0.06 times a second wavelength, the first wavelength being a wavelength in the dielectric slab and corresponding to a transmission band center frequency of the FSS, and the second wavelength being a wavelength in vacuum and corresponding to a reflection band center frequency of the FSS; and the N square-ring metal patches are adhered to the first surface of the dielectric slab and are arranged uniformly, N being a positive integer power of 4.

2. The FSS according to claim 1, wherein a perimeter of a center line of the square-ring metal patch is 0.5 to 1.5 times of the second wavelength, and the center line is located in the middle between an outer ring and an inner ring of the square-ring metal patch.

3. The FSS according to claim 1, wherein a thickness of the dielectric slab is half of the first wavelength.

4. The FSS according to claim 1, wherein the dielectric slab in the FSS unit has N holes, positions of the N holes are in a one-to-one correspondence with positions of the N square-ring metal patches, and an area of the hole is less than an area of an inner ring of the square-ring metal patch.

5. The FSS according to claim 4, wherein centers of the N holes are respectively located at center positions of the dielectric slab covered by the N square-ring metal patches.

6. The FSS according claim 1, wherein when N is equal to 4, the length of the cross-shaped metal patch in each direction is 0.3 to 0.6 times of the first wavelength; and a perimeter of the center line of the square-ring metal patch is 1.0 to 1.5 times of the second wavelength, and the center line is located in the middle between an outer ring and an inner ring of the square-ring metal patch.

7. The FSS according to claim 1, wherein when N is equal to 16, the length of the cross-shaped metal patch in each direction is 0.4 to 0.7 times of the first wavelength; and a perimeter of the center line of the square-ring metal patch is 0.7 to 1.3 times of the second wavelength, and the center line is located in the middle between an outer ring and an inner ring of the square-ring metal patch.

8. An antenna, wherein the antenna comprises a primary reflector, a frequency selective surface (FSS), and a low frequency feed and a high frequency feed share the primary reflector, wherein the FSS comprises multiple FSS units that are uniformly arranged, each FSS unit comprising a dielectric slab and N square-ring metal patches, and a cross-shaped metal patch, wherein the cross-shaped metal patch is adhered to the first surface of the dielectric slab, and divides the first surface of the dielectric slab into four parts, each part having a same size and a same quantity of the square-ring metal patches, wherein lengths of the cross-shaped metal patch in two mutually perpendicular directions are equal, a length in each direction is 0.25 to 0.75 times of a first wavelength, and a width of a gap between adjacent patches is 0.02 to 0.06 times of a second wavelength, the first wavelength being a wavelength in the dielectric slab and corresponding to a transmission band center frequency of the FSS, and the second wavelength is a wavelength in vacuum and corresponding to a reflection band center frequency of the FSS; and the N square-ring metal patches are adhered to the first surface of the dielectric slab and are arranged, N being a positive integer power of 4.

9. The antenna according to claim 8, wherein a perimeter of a center line of the square-ring metal patch is 0.5 to 1.5 times of the second wavelength, and the center line is located in the middle between an outer ring and an inner ring of the square-ring metal patch.

10. The antenna according to claim 8, wherein a thickness of the dielectric slab is half of the first wavelength.

11. The antenna according to claim 8, wherein the dielectric slab in the FSS unit has N holes, positions of the N holes are in a one-to-one correspondence with positions of the N square-ring metal patches, and an area of the hole is less than an area of an inner ring of the square-ring metal patch.

12. The antenna according to claim 11, wherein centers of the N holes are respectively located at center positions of the dielectric slab covered by the N square-ring metal patches.

* * * * *